US009765945B2

(12) United States Patent
Scordino et al.

(10) Patent No.: US 9,765,945 B2
(45) Date of Patent: Sep. 19, 2017

(54) LIGHTING DEVICE

(71) Applicant: OSRAM GmbH, Munich (DE)

(72) Inventors: Alessandro Scordino, Dolo (IT); Alberto Alfier, Vedelago (IT); Dina Pasqualini, Udine (IT); Marco Lamonato, Crocetta del Montello / Treviso (IT)

(73) Assignee: Osram GmbH, Munich (DE)

( * ) Notice: Subject to any disclaimer, the term of this patent is extended or adjusted under 35 U.S.C. 154(b) by 464 days.

(21) Appl. No.: 14/377,891

(22) PCT Filed: Mar. 4, 2013

(86) PCT No.: PCT/EP2013/054294

§ 371 (c)(1),
(2) Date: Aug. 11, 2014

(87) PCT Pub. No.: WO2013/131858

PCT Pub. Date: Sep. 12, 2013

(65) Prior Publication Data

US 2015/0043207 A1 Feb. 12, 2015

(30) Foreign Application Priority Data

Mar. 7, 2012 (IT) ..... TO2012A0198

(51) Int. Cl.
*F21V 11/00* (2015.01)
*F21V 7/06* (2006.01)
(Continued)

(52) U.S. Cl.
CPC ..... *F21V 7/06* (2013.01); *F21S 8/032* (2013.01); *F21S 8/08* (2013.01); *F21V 7/00* (2013.01);
(Continued)

(58) Field of Classification Search
CPC ..... F21V 7/06; F21S 8/08; F21S 8/032
See application file for complete search history.

(56) References Cited

U.S. PATENT DOCUMENTS

2004/0218384 A1* 11/2004 Newton ..... F21L 4/08 362/183
2007/0217193 A1 9/2007 Lin et al.
(Continued)

FOREIGN PATENT DOCUMENTS

CN 1762061 A 4/2006
CN 101725856 A 6/2010
(Continued)

OTHER PUBLICATIONS

English Translation of KR 20060036039.*
(Continued)

*Primary Examiner* — Evan Dzierzynski
(74) *Attorney, Agent, or Firm* — Viering, Jentschura & Partner mbB

(57) ABSTRACT

A lighting device may include a channel-shaped housing having two ends with a main axis of the housing extending between the ends, a pair of mounting fixtures for a pair of light radiation sources within the housing with the light radiation sources radiating light radiation in opposite directions along the main axis, and a pair of reflectors each facing a respective one of the mounting fixtures to receive light radiation along the main axis and reflect it to the outside of the housing.

12 Claims, 5 Drawing Sheets

(51) Int. Cl.

| | |
|---|---|
| ***F21S 8/08*** | (2006.01) |
| ***F21V 7/00*** | (2006.01) |
| ***F21S 8/00*** | (2006.01) |
| ***F21V 15/01*** | (2006.01) |
| ***F21V 17/02*** | (2006.01) |
| *F21W 131/103* | (2006.01) |
| *F21Y 115/10* | (2016.01) |

(52) U.S. Cl.
CPC ..... *F21V 7/0025* (2013.01); *F21V 15/01* (2013.01); *F21V 17/02* (2013.01); *F21W 2131/103* (2013.01); *F21Y 2115/10* (2016.08)

(56) References Cited

U.S. PATENT DOCUMENTS

| | | | | |
|---|---|---|---|---|
| 2007/0263393 | A1 | 11/2007 | Van De Ven | |
| 2010/0110680 | A1 | 5/2010 | Bianco et al. | |
| 2012/0051060 | A1* | 3/2012 | Derome | F21V 7/0025 362/294 |
| 2012/0281397 | A1* | 11/2012 | Kong | F21V 17/02 362/225 |

FOREIGN PATENT DOCUMENTS

| | | | |
|---|---|---|---|
| CN | 102027290 | A | 4/2011 |
| CN | 102057214 | A | 5/2011 |
| CN | 102192446 | A | 9/2011 |
| DE | 102009044387 | A1 | 5/2011 |
| EP | 2360421 | A1 | 8/2011 |
| KR | 20060036039 | * | 4/2006 |
| WO | 2005055328 | A1 | 6/2005 |
| WO | 2009143724 | A1 | 12/2009 |
| WO | 2009150586 | A1 | 12/2009 |
| WO | 2010070565 | A1 | 6/2010 |

OTHER PUBLICATIONS

Chinese Office Action (including Chinese Search Report) based on application No. 201380013219.9 (7 pages and 7 pages of English translation) dated Jul. 25, 2016.

Chinese Office Action based on Application No. 201380013219.9(7 Pages and 9 pages of English translation) dated Dec. 16, 2015.

International Search Report issued in the corresponding PCT application No. PCT/EP2013/054294, dated May 16, 2013.

Search Report issued in the corresponding Italian application No. TO2012A000198, dated Aug. 30, 2012.

English abstract of DE 102009044387 of May 12, 2011.

Chinese Office Action based on application No. 201380013219.9 (8 pages and 8 pages of English translation) dated Dec. 9, 2016.

* cited by examiner

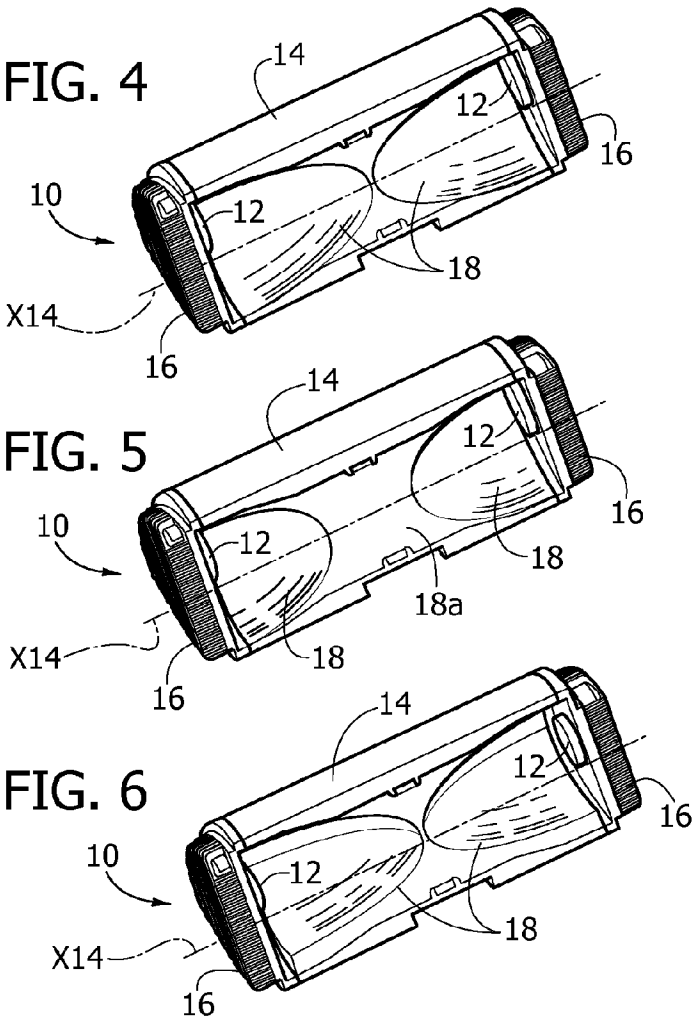
FIG. 4
FIG. 5
FIG. 6
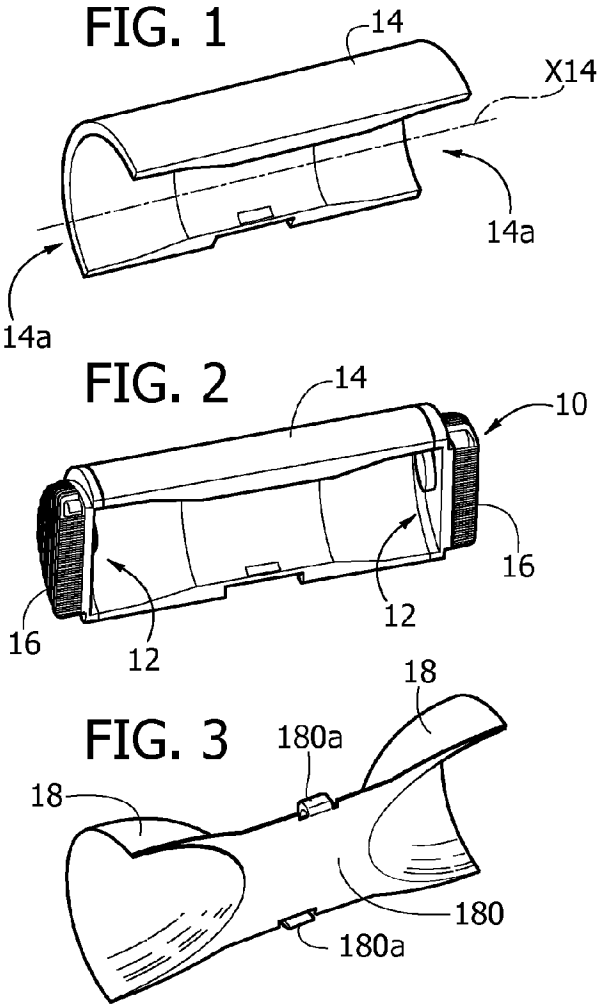
FIG. 1
FIG. 2
FIG. 3

LIGHTING DEVICE

RELATED APPLICATIONS

The present application is a national stage entry according to 35 U.S.C. §371 of PCT application No.: PCT/EP2013/054294 filed on Mar. 4, 2013, which claims priority from Italian application No.: TO2012A000198 filed on Mar. 7, 2012, and is incorporated herein by reference in its entirety.

TECHNICAL FIELD

Various embodiments may refer to lighting devices which can use LED sources as light radiation sources.

BACKGROUND

The regulations concerning lighting, for example in the field of road lighting (see for example the standards UNI 10439, UNI 11248, UNI EN 13201-2/3/4), deal with subjects such as the selection of the lighting classes, the needs in terms of lighting, the measurement methods and the calculation of the performances in terms of lighting.

At least at present, however, there are no specific standards relating to the installation geometry, for example in the context of road lighting, in relation to factors such as, for example, the height of the posts, the distance between the posts or the width of the road.

The lack of specific definitions in relation to the mounting conditions, for example in the context of a road, inevitably results in ambiguity in terms of selection and of configuration of the lighting device (luminaire) most suited for lighting a certain roadway. All this with the risk that lighting devices designed according to fixed optical criteria and thus with a certain radiation diagram may be installed in an unsuitable road setting.

To try and alleviate the problem and provide lighting devices able to adapt to different settings, solutions used to date provide, for example, for setting the radiation diagram differently and/or for using different lenses which adapt to the same light radiation source (for example an LED light radiation source) or if need be to a full range of lighting devices.

These solutions are not completely satisfactory, however.

By way of example, the process of tilting the lighting device merely makes it possible to vary the inclination of the radiation diagram, and in some cases there is the risk of causing phenomena relating to dazzling and light pollution of the sky.

The use of lenses makes it possible to keep the light radiation source (for example an LED light radiation source) fixed, thereby making it possible to pass from one radiation diagram to another. On the other hand, lenses, in particular those for outdoor application, are subject to a number of disadvantages, such as for example yellowing due to ultraviolet rays.

Beyond this, the fact that it is necessary to provide an entire range of different devices which satisfy different optical requirements is not particularly efficient in terms of costs when confronted with the possibility of having a modular system.

SUMMARY

Therefore, there remains the need to provide lighting devices, which can be used for example in the context of road lighting, which make it possible to give rise to different lighting configurations, for example depending on different heights of the post and on different installation distances between the posts, on the dimensions of the roadway and depending on specific purposes (pedestrianized roads, roads with slow-moving or fast-moving traffic).

In particular, there remains the need to solve one or more of the following problems:

- the provision of interchangeability within a range of reflectors which can be associated with a lighting device keeping the light radiation source (for example an LED light radiation source) and/or the housing of the device unchanged,
- easy mechanical assembly and disassembly of the reflectors of the device,
- sufficient lighting in different road contexts which can be obtained by selecting a suitable reflector,
- the possibility to use more extensive sources than a Lambertian source, for example for road lighting applications,
- modular approach in the provision of several different modules depending on the application.

Various embodiments offer one or more of the following advantages:

- the possibility to use lighting sources (for example LED lighting sources) with more extensive radiation features than Lambertian sources, for example for road lighting applications,
- the possibility to avoid resorting to lenses, thus avoiding the disadvantages linked, for example, to the yellowing of the optical parts following exposure to ultraviolet rays,
- the possibility to have a mechanical snap fitting system which makes it possible to easily mount a reflector in the respective housing and to remove it if required,
- the possibility to install and remove a reflector in and from the housing without thereby giving rise to interference with the light radiation source,
- the availability of a range of reflectors which can be mounted on the same housing,
- the possibility to have reflectors which are symmetrical along the light emission axis of the light radiation sources so as to give rise to a symmetrical lighting beam or, alternatively, reflectors with features of different curvature so as to make it possible to give rise to different radiation diagrams,
- the possibility to select reflectors with the desired features (symmetrical, asymmetrical, with different curvatures, etc.) so as to provide a desired degree of lighting, for example in road settings,
- the applicability of the same concept to an individual module or to an array of modules, depending on the application,
- extensive freedom for determining the arrangement of the lighting modules depending on the applications.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which:

FIG. 1 shows a component of one embodiment,

FIG. 2 shows the mounting of light radiation sources on one embodiment,

FIG. 3 shows a part of one embodiment,

FIG. 4 shows an assembled embodiment,

FIGS. 5 and 6 show assembled embodiments,

DETAILED DESCRIPTION

Figure 7:
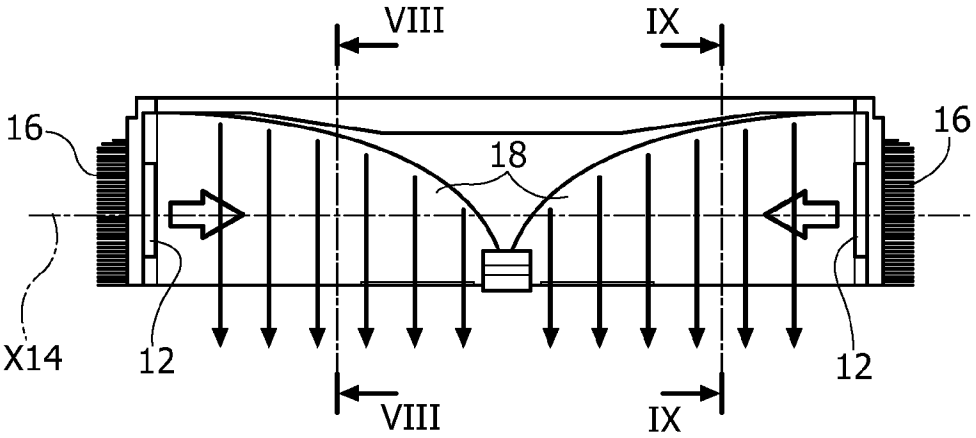
FIGS. 7 to 9 schematically show the principles of emission of the light radiation in various embodiments, where FIGS. 8 and 9 can be regarded as ideal sections along the lines VIII-VIII and IX-IX in FIG. 7.

The following description explains various specific details aimed at providing a fuller understanding of various exemplary embodiments. The embodiments may be implemented without one or more of the specific details or using other methods, components, materials, etc. In other cases, known structures, materials or operations are not shown or described in detail so that various aspects of the embodiments may be understood more clearly.

The reference to "an embodiment" in the context of this description indicates that a particular configuration, structure or feature described in relation to the embodiment is included in at least one embodiment. Therefore, phrases such as "in one embodiment", which may occur at various points in this description, do not necessarily refer to the same embodiment. Moreover, particular forms, structures or features may be combined in any suitable manner in one or more embodiments.

The reference numbers used here are provided solely for the sake of convenience and therefore do not define the scope of protection or ambit of the embodiments.

In the figures, the reference number 10 denotes a lighting device as a whole, which can accommodate, as light radiation sources, two light radiation sources 12.

In various embodiments, the light radiation sources 12 may be LED sources.

In various embodiments, these may be sources including a so-called cluster of tightly packed LEDS able to supply a beam angle which is more extensive than that of a Lambertian emitter.

In various embodiments, the device 10 may include a housing 14 constituted, for example, by a body of molded material, such as for example a plastic material or a light metal (for example aluminum).

In various embodiments, the channel-shaped housing 14 may have a general tile-shaped form and thus may have an at least approximately semicircular cross section.

The housing 14 extends along a main axis X14 between two ends 14*a* so that it can receive there two support members 16 that can be integrated in a pair of semicircular caps.

Each of the two members 16 is intended to support a light source 12 in a condition in which the two light sources 12 face one another and are aligned with the main axis X14 of the device.

In various embodiments, in the case of a housing 14 extending over an ideal cylindrical surface along an axis X14, the axis X14 may coincide approximately with the axis of the aforementioned cylindrical surface.

The light sources 12 are mounted on the mounting fixtures 16 in such a way as to face one another, in the sense that the sources 12 project the light radiation emitted thereby toward the inside of the housing 14.

In other words, and leaving aside the presence of the reflectors 18, which are explained further hereinbelow, in various embodiments the radiation sources 12 (individual or multiple) may project the respective light radiations against one another.

In various embodiments, the radiation sources 12 can thus project the respective radiations in opposing directions along the axis X14, i.e. in the direction indicated by the axis X14 itself.

Figure 13:
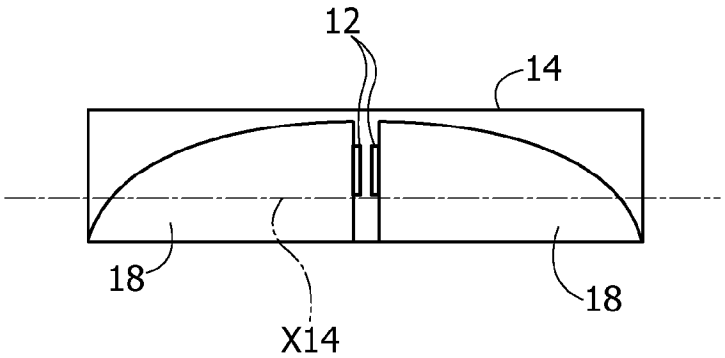
FIG. 13 shows a geometry of embodiments.
Figure 12:
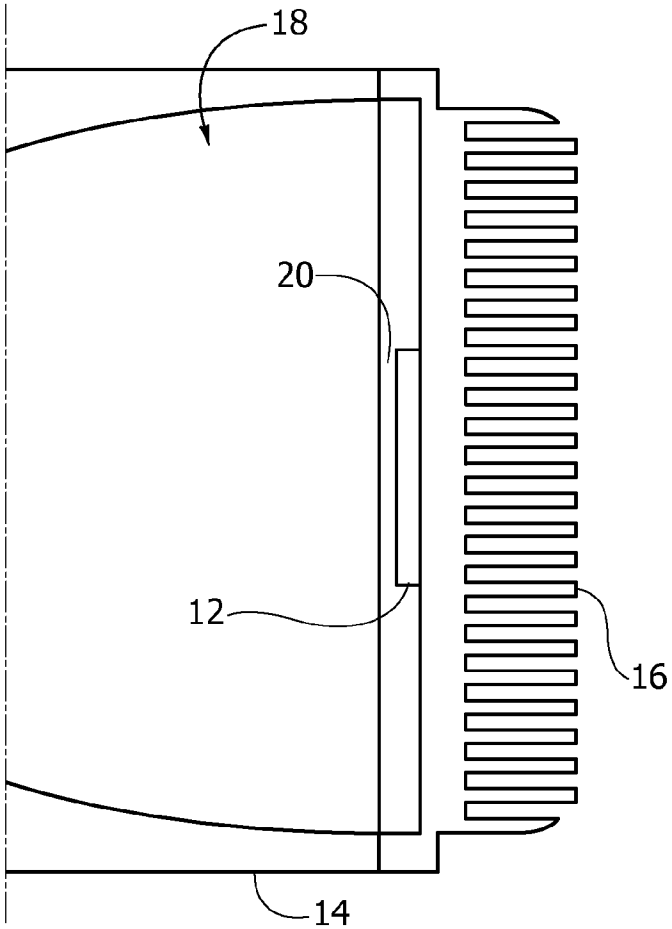
FIG. 12 shows a detail of embodiments.

Without affecting the principle where the radiation sources 12 may thus project the respective radiations in opposing directions along the axis X14, it may be provided in various embodiments that, instead of being mounted face-to-face at the ends of the housing 14, and instead of emitting the respective radiations in directions which converge toward the inside of the housing 14 (therefore, one against the other according to the embodiments to which FIGS. 1 to 12 and 14 to 16 refer), the sources 12 are mounted back-to-back in an approximately central position with respect to the housing 14 and always emit the light radiation in opposing directions along the axis X14, but not in directions which converge toward the inside of the housing 14, but rather in directions which diverge toward the outside of the housing 14 (as shown schematically in FIG. 13).

In this respect, it is understood that all of the features illustrated here with reference to embodiments in which the light radiation sources emit in the direction toward the inside of the housing, one against the other (FIGS. 1 to 12 and 14 to 16), are applicable in an identical manner to embodiments which instead adopt the geometry shown in FIG. 13, in which the sources 12 radiate their light radiation toward the ends of the housing 14.

As already mentioned above, a reflector 18 can be coupled to each support fixture 16 (thus to each light radiation source 12 mounted thereon).

Each reflector 18 is therefore able to receive, from the light radiation source 12 to which it is coupled, the light radiation which propagates along the main axis X14 to reflect this radiation to the outside of the housing 14, as shown schematically in FIG. 7.

In various embodiments, the radiators 18 can be produced in the form of shaped bodies having a general scoop-shaped configuration, for example a half-paraboloid form.

In various embodiments, the radiators 18 can be produced, for example, from molded plastic material, which has possibly been subjected to a treatment to make it reflective, for example an aluminization treatment, or a body made of light metal such as aluminum, which has possibly been subjected to such a treatment.

FIGS. 4 to 9 show that the structure just described lends itself to being produced with different features, particularly with respect to the reflectors 18.

By way of example, FIGS. 4 to 6 illustrate the possibility to vary, in respect of the reflectors 18:

- the overall dimensions (for example, the reflectors 18 which can be seen in FIGS. 4 and 6 are generally "longer" than the reflectors 18 which can be seen in FIG. 5);
- the distance which separates the reflectors 18 even independently of the dimensions thereof (for example, the two reflectors 18 shown in FIG. 5 are separated from one another by a solid section 18*a*, whereas the top parts of the reflectors 18 shown in FIGS. 4 and 6 are virtually in contact with one another);

in general the shape of the reflectors 18 (for example, the reflectors 18 which can be seen in FIG. 4 are "wider" than the reflectors 18 in FIG. 6).

Figure 9:
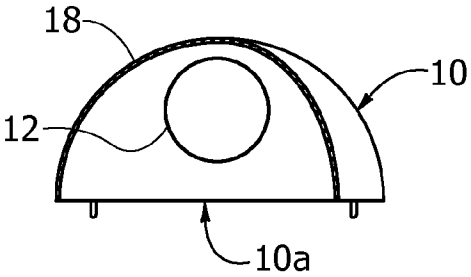
Figure 8:
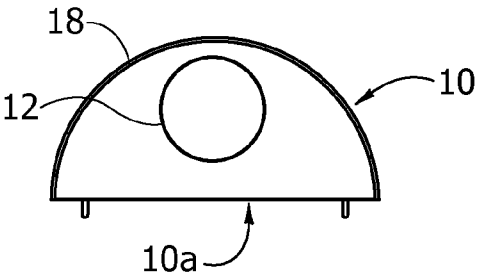
Figure 11:
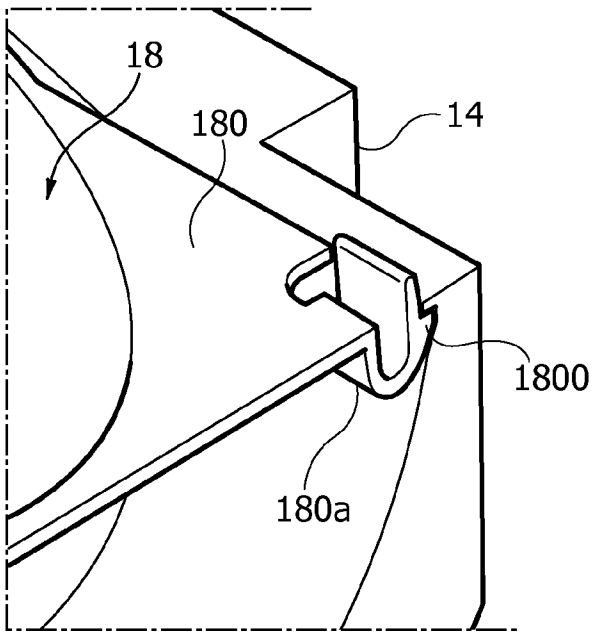
FIG. 11 is a view according to the arrow XI in FIG. 10, reproduced on an enlarged scale.
Figure 10:
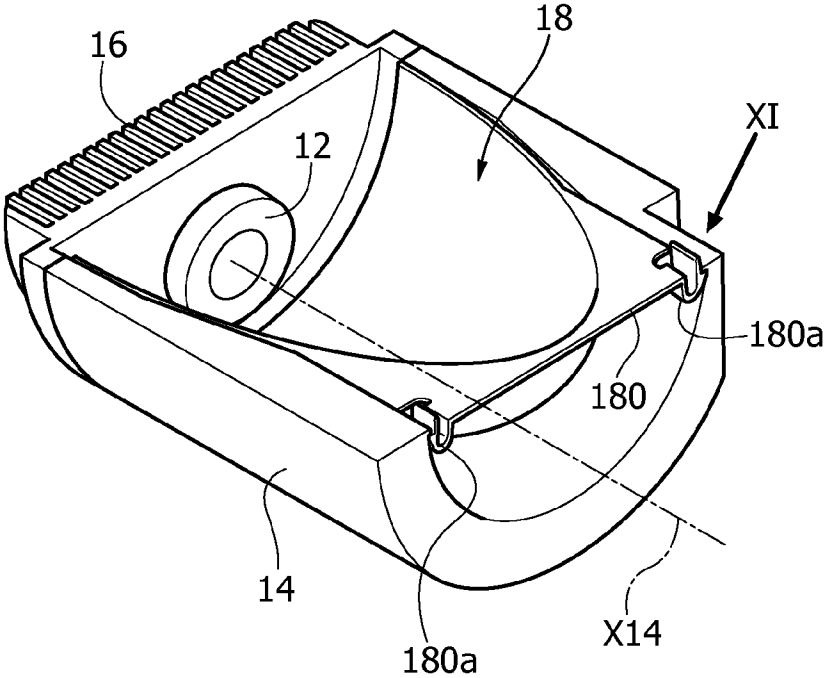
FIG. 10 shows a constructional detail of embodiments.

FIGS. 8 and 9, which can be regarded as ideal sectional views along the lines VIII and IX in FIG. 7, also show that, in the case shown in FIG. 8, the reflector 18 shown therein has a progression which is symmetrical with respect to the mounting position of the light source 12 with which the reflector 18 is associated.

On the contrary, the view in FIG. 9 illustrates the possibility of assigning the reflector 12 an asymmetrical shape.

In the case of the symmetrical shape shown in FIG. 8, the light radiation beam emitted by the device 10 will generally have a distribution which is symmetrical with respect to the plane of the mouth of the device 10, denoted by 10*a*.

On the contrary, with recourse to the solution shown in FIG. 9, the light radiation beam emitted by the device 10 will generally have a non-symmetrical spatial distribution with respect to the plane of the mouth 10*a*.

The aforementioned symmetry/asymmetry may be defined as a rotational symmetry/asymmetry inasmuch as, in the example of FIG. 8, the surface of the reflector 18 may be regarded as ideally generated by the rotation (through 180°) of a curve (for example parabolic) about a main axis. In the example of FIG. 9, the surface of the reflector 18 does not have this feature of symmetry, however.

The various possibilities described above can be applied to the two reflectors 18 in an identical manner or in a diverse manner, and therefore, for example, a device 10 according to various embodiments could include, for example:

two "symmetrical" reflectors 18, as schematized in FIG. 8, which are identical or differ from one another in other features;

two "asymmetrical" reflectors 19, as shown in FIG. 9, which are identical or differ from one another in other features;

a "symmetrical" reflector 18, as schematized in FIG. 8, and an "asymmetrical" reflector, as shown in FIG. 9.

By way of example, the availability of symmetrical reflectors lends itself to the mounting of the device 10 in a central position with respect to a roadway, whereas, for example, asymmetrical reflectors may be more suitable for use on the side of the roadway.

With respect to the mounting of the reflectors 18 on the housing 14, various embodiments may have one or more of the features presented hereinbelow.

By way of example, as shown schematically in FIG. 3, the two reflectors 18 may be formed integrally together with an intermediate member 180 which separates them, with the member 180 provided with spring-like lateral fins 180*a*, for example by teeth-shaped parts 1800 (more clearly visible in the views of FIGS. 10 and 11) which can engage with a snap fit with the inner surface of the housing 14.

The aforementioned snap-fitting engagement makes it possible to easily install the reflectors 18 within the body 14.

In particular, observing FIGS. 4 to 6 makes it possible to realize that, in various embodiments, it is possible to associate an assortment of interchangeable reflectors 18 of different shapes to the same housing 14.

The availability of such an assortment may be useful at an installation level: the fitter can decide, depending on the position of the device 10, to mount on the housing 14 the reflectors 18 which are considered most suitable depending on the application requirements, selecting them within the framework of such an assortment.

The availability of such an assortment may also be useful to make it possible, for example in ambient lighting contexts, for example for display purposes, to selectively modify, depending on the desires and the requirements, the lighting features of the individual device 10 by replacing the reflectors 12, but leaving unchanged the rest of the device, which may be left mounted where it already was, without having to be removed from the installation site in order to change the reflectors 18.

In various embodiments (as can be gathered instantly in the view of FIG. 12), it may be provided that the dimensions of the reflectors 18 (for example when connected to one another integrally coupled with the intermediate member 180) are those whereby the edge of the mouth of the reflector 12 remains at a certain distance with respect to the corresponding mounting fixture 16, so as to always leave a clearance 20 between the reflector 18 and the radiation source 12 mounted on the support fixture 16. It is thereby possible to insert and/or remove the reflector 16, for example to replace it with a different reflector, without having to remove the corresponding radiation source 12.

Various embodiments (as shown schematically in FIG. 12) provide that the coupling, for example with snap fitting, between the reflector 18 and the housing 14 provides for the presence of teeth 1800 such as to ensure that, once inserted within the housing 14, the reflector 18 is in a virtually fixed position.

In various embodiments, although retaining the possibility of easy assembly and disassembly (for example with snap-fitting coupling), it is possible to ensure that the reflector 18, once inserted within the housing 14, retains the ability to rotate, at least through a controlled angle, for example with respect to the axis X14. In this way, it is possible to vary the spatial orientation of the light radiation beams emerging from the reflectors 18, keeping the device 10 in a fixed (mounting) position.

As already stated, FIG. 13 illustrates the fact that, in various embodiments (retaining virtually all the possibilities of realizing details described above with reference to the embodiments of FIGS. 1 to 12), it is possible to provide that the light sources 12 are mounted back-to-back in a central position with respect to the housing 14, with the reflectors 18 mounted on the outside of the light radiation sources 12 to reflect, toward the outside of the device 10, the radiation which the sources of FIG. 13 project from the center toward the ends of the housing 14.

Figure 15:
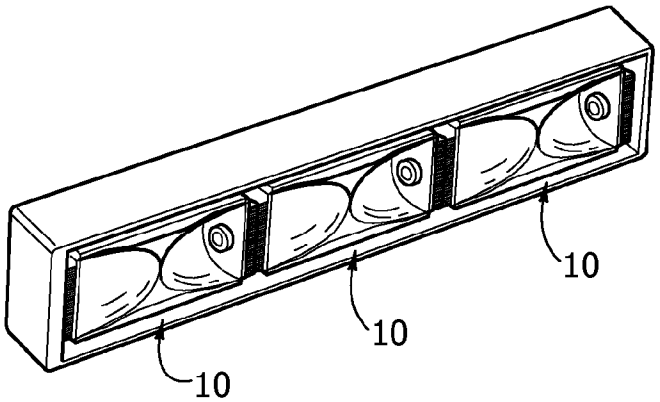
FIGS. 14 to 16 show various embodiments.
Figure 16:
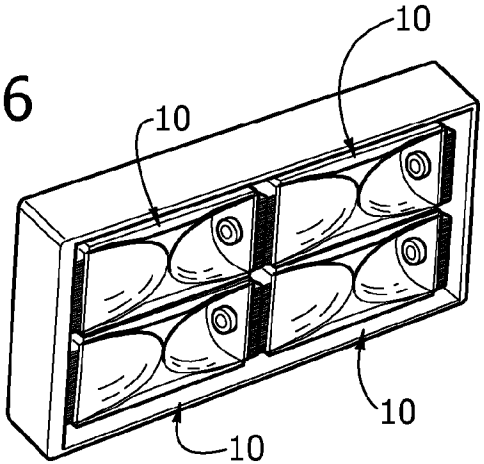
Figure 14:
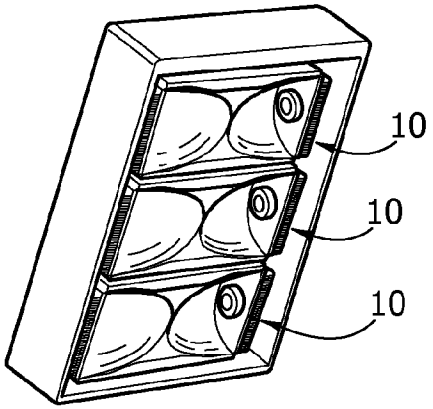

FIGS. 14 to 16 schematically show the possibility of coupling a plurality of devices 10 of the type described above to one another, in accordance with a modular approach, for example by arranging a plurality of devices 10 (for example three—but of course this selection is not imperative in any way) in linear arrays (with the devices 10 aligned in length or width), or else by arranging a plurality of devices 10 in a matrix distribution, for example, as schematized in FIG. 16, which shows four devices 10 arranged in a 2×2 matrix arrangement.

Without affecting the principle of the disclosure, the constructional details and the embodiments may therefore vary, also significantly, with respect to that shown here purely by way of non-limiting example, without thereby departing from the scope of protection of the disclosure, which scope of protection is defined by the accompanying claims.

The invention claimed is:

1. A lighting device comprising:

a channel-shaped housing having two ends with a main axis of the housing extending between said ends, a pair of mounting fixtures for a pair of light radiation sources within said housing with said light radiation sources radiating light radiation in opposite directions along said main axis, and a pair of reflectors each facing a respective one of said mounting fixtures to receive light radiation along said main axis and reflect it to the outside of the housing, wherein said reflectors are mounted removably in said housing; and wherein said reflectors are mounted at a distance with respect to said mounting fixtures to leave a clearance between said reflectors and the light radiation sources mounted in said fixtures for replacing said reflectors without removing any other parts.

2. The device as claimed in claim 1, wherein said mounting fixtures are arranged at said two ends of the housing with said light radiation sources radiating light radiation toward the inside of the housing.

3. The device as claimed in claim 1, wherein said reflectors are scoop-shaped reflectors.

4. The device as claimed in claim 1, wherein at least one of said reflectors has a rotationally symmetrical shape.

5. The device as claimed in claim 1, wherein at least one of said reflectors has a rotationally asymmetrical shape.

6. The device as claimed in claim 1, wherein at least one of said reflectors is mounted in said housing rotatable with respect to said main axis to vary the direction in which the light radiation is reflected to the outside of the housing.

7. The device as claimed in claim 1, wherein said reflectors are mounted removably by snap fitting in said housing.

8. The device as claimed in claim 1, wherein the device is supplemented with an assortment of interchangeable reflectors of different shapes.

9. The device as claimed in claim 1, wherein said reflectors are connected to one another by an intermediate member formed integrally with said reflectors.

10. The device as claimed in claim 1, wherein said reflectors are scoop-shaped reflectors in the form of half-paraboloids.

11. A lighting device comprising:

a channel-shaped housing having two ends with a main axis of the housing extending between said ends, a pair of mounting fixtures for a pair of light radiation sources within said housing with said light radiation sources radiating light radiation in opposite directions along said main axis, and a pair of reflectors each facing a respective one of said mounting fixtures to receive light radiation along said main axis and reflect it to the outside of the housing, wherein the reflectors are mounted with a clearance between an edge of the mouth of the reflectors and a top surface of the light radiation sources sufficient to be replaceable independently.

12. A lighting device comprising:

a channel-shaped housing having two ends with a main axis of the housing extending between said ends, a pair of mounting fixtures for a pair of light radiation sources within said housing with said light radiation sources radiating light radiation in opposite directions along said main axis, and a pair of reflectors each facing a respective one of said mounting fixtures to receive light radiation along said main axis and reflect it to the outside of the housing, wherein the reflectors are mounted with a clearance between an edge of the mouth of the reflectors and a top surface of the light radiation sources sufficient to be replaceable without removing any other parts.

* * * * *